United States Patent [19]

Kisler

[11] 4,363,070

[45] Dec. 7, 1982

[54] NEUTRALIZATION OF ELECTROSTATIC CHARGES

[75] Inventor: Semyon Kisler, West Newton, Mass.

[73] Assignee: Polaroid Corporation, Cambridge, Mass.

[21] Appl. No.: 183,323

[22] Filed: Sep. 2, 1980

[51] Int. Cl.[3] ..... H05F 3/00

[52] U.S. Cl. ..... 361/212; 361/221

[58] Field of Search ..... 361/212, 221, 214

[56] References Cited

U.S. PATENT DOCUMENTS

| | | | |
|---|---|---|---|
| 2,163,294 | 6/1939 | Simons . | |
| 2,333,213 | 11/1943 | Slayter . | |
| 3,308,045 | 3/1967 | Sullivan | 361/221 |
| 3,671,806 | 6/1972 | Whitmore et al. | 361/221 X |
| 3,757,164 | 9/1973 | Binkowski | 361/212 |
| 3,863,108 | 1/1975 | Blythe et al. | 361/221 |

FOREIGN PATENT DOCUMENTS

| | | | |
|---|---|---|---|
| 581695 | 12/1924 | France | 361/214 |

OTHER PUBLICATIONS

"Controlling Polar Charge with Low Electrical Potentials", *Research Disclosure,* Feb. 1980, p. 70.

*Primary Examiner*—G. Z. Rubinson
*Assistant Examiner*—L. C. Schroeder
*Attorney, Agent, or Firm*—John J. Kelleher

[57] ABSTRACT

Apparatus including a brush-like device having an array of conductive filaments is able to neutralize electrostatic charges on, for example, a moving web of charge-retaining materials by passing said web through the alternating electrostatic field established by said device when it is electrically connected to a relatively low potential AC source having the proper magnitude and frequency.

12 Claims, 6 Drawing Figures

NEUTRALIZATION OF ELECTROSTATIC CHARGES

BACKGROUND OF THE INVENTION

1. Field of the Invention

The present invention relates to apparatus for neutralizing electrostatic charges, on charge-retaining materials, in general, and to such apparatus for neutralizing electrostatic charges on a moving web of such material, in particular.

2. Description of the Prior Art

The presence of electrostatic charges on charge-retaining materials causes problems in many industries. In the photographic industry, for example, electrostatic charges on potential photographs or film units within a light-tight film cassette containing a plurality of film units for use in an "instant" type photographic camera, such as that sold by Polaroid Corporation, Cambridge, Massachusetts, under its registered trademark "SX-70", will often cling to one another with such intensity as a result of the force of attraction developed by such electrostatic charges, that proper ejection of an exposed film unit from said film cassette can be prevented if the effects of such charges are not controlled. In the SX70 photographic film mentioned above, for example, electrostatic charges are controlled by controlling the charge levels on components of said film prior to final film assembly.

Troublesome electrostatic charges on charge-retaining materials can be conveniently grouped into either of two catagories. One catagory is that of polarization charges, sometimes referred to a dipoles, and the other is that of free surface charges. Polarization charges are bound to a definite site in a solid, whereas free surface charges are not. Free surface charges on a moving web of certain materials, for example, are frequently neutralized by a grounded brushlike device such as that described in U.S. Pat. No. 3,575,164 to BINKOWSKI. Polarization charges in such a web are commonly controlled by subjecting the web to a corona-generated electrostatic field having a particular magnitude and polarity. It is often necessary to deal with both categories of charges.

The polarity of polarization charges or dipoles on charge-retaining materials may be positive, negative, or a combination of both. If both positive and negative charges should be present in the same charge-retaining material and if said positive and negative charges are to be neutralized by having their charge levels reduced to zero, the application of a DC-type electrostatic field having either a positive or a negative polarity will not reduce the charge level of both positive and negative charges to zero. If, for example, a DC-type electrostatic field having a particular polarity is successfully employed to neutralize one kind of polarity charge (positive or negative), the opposite polarity charge from that which is neutralized will have its charge level undesirably increased and not neutralized or reduced to the zero level that is preferred.

Apparatus that includes a corona-generated electric field can be effectively employed to neutralize polarization charges. However, corona has several undesirable properties. A corona generates ozone gas and ozone can cause some individuals to become ill. Even if illness does not result from the ozone, it has a pungent odor that is objectionable to most people, especially in an environment where ventilation is relatively poor or nonexistent. When a corona is employed to control polarization charges on a web of light-sensitive material, means must be provided to prevent light produced by the corona from reaching and thereby damaging said material. In addition, it is often necessary to expend significant quantities of relatively costly electric power in order to generate and maintain a corona-type electrostatic field for charge neutralizing purposes.

SUMMARY OF THE INVENTION

In accordance with the teachings of the present invention, apparatus is provided for neutralizing electrostatic charges on charge-retaining materials. The apparatus includes an electrically conductive reference surface, a brush having conductive bristles or filaments with one end of each of said filament being connected to a common electrical conductor, and an AC potential source connected between said common electrical conductor and said reference surface. The magnitude and frequency of said potential source is selected such that the proper alternating electrostatic field is established between said bristles and said reference surface for the purpose of neutralizing both positive and negative electrostatic charges on charge-retaining materials passing between said bristles and said reference surface, said potential magnitude being less than that required for the generation of a corona.

DESCRIPTION OF THE PREFERRED EMBODIMENTS

Figure 1:
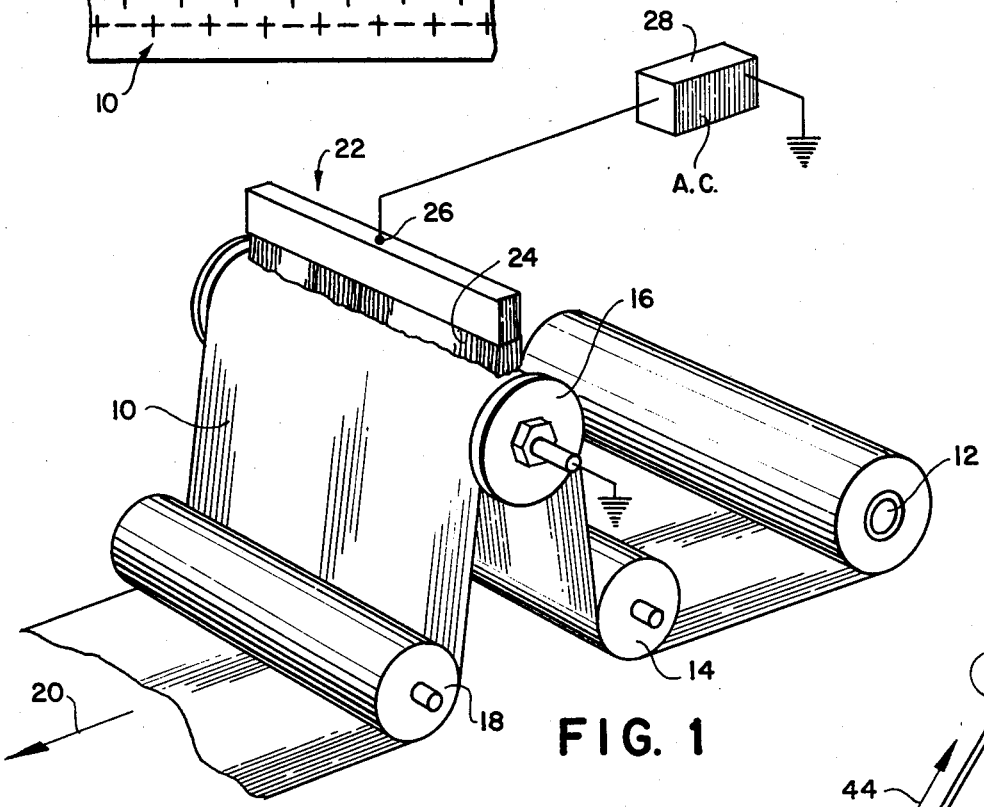
FIG. 1 is a perspective view of a schematic of the charge neutralizing apparatus of the present invention and a moving web of charge-retaining material having its electrostatic charge neutralized by said apparatus.

Turning now to the drawings, in FIG. 1, a perspective view of a schematic diagram of the electrostatic charge neutralizing apparatus of the present invention and a moving web of charge-retaining sheet material 10 having its electrostatic charge neutralized by said apparatus, are depicted. A roll of said plastic sheet material 10 is moved over rotatably mounted cylindrical backing rollers 12, 14, 16 and 18 in direction 20 at the desired rate of web 10 movement by suitable drive means (not shown) coupled to said web 10.

Brush 22 is mounted in a fixed position and in a spaced relation with respect to web 10 and roller 16. The construction of brush 22 will be described below in detail. For the present, however, it should be noted that brush 22 does include a multiplicity of conductive bristles or filaments 24 with an end of each of said filaments being electrically connected to common electrical conductor 26. Backing roller 16 is constructed of electrically conductive materials and said roller 16 is connect to ground potential. AC potential source 28 is connected between common electrical conductor 26 on brush 22 and ground potential, causing an alternating and relatively intense electric field to be established between the free ends of bristles 24 of brush 22 and backing roller 16. The use of a multiplicity of conductive bristles or filaments in the form of brush 22 electrically coupled to a suitable potential source results in an electrostatic field being established with an electrical potential whose magnitude is substantially less than that necessary for the generation of corona. The reason for being able to establish a relatively intense field with a relatively low magnitude voltage will be explained below in detail.

Figure 2:
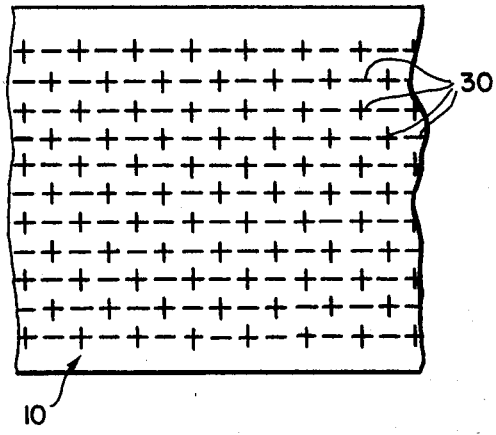
FIG. 2 is a top view of a portion of the moving web of FIG. 1 showing the electrostatic charge distribution of said web.

FIG. 2 shows a top view of a portion of charge-retaining web material 10 depicted in FIG. 1. As shown in FIG. 2, positive and negative polarization charges 30, having various magnitudes, are distributed throughout web 10. Referring again to FIG. 1, as web 10 is moved in direction 20 over roller 16 between the free ends of bristles 24 of brush 22 and grounded roller 16, through the relatively intense alternating electrostatic field established between said free ends and said roller 16, electrostatic charges retained by said web 10 are neutralized by said electrostatic field. The magnitude and frequency of the potential that is supplied by potential source 28 is established before web 10 is so moved, by empirically determining the electrostatic field intensity and its frequency of oscillation that is necessary to neutralize the electrostatic charge on said web 10.

Figure 3:
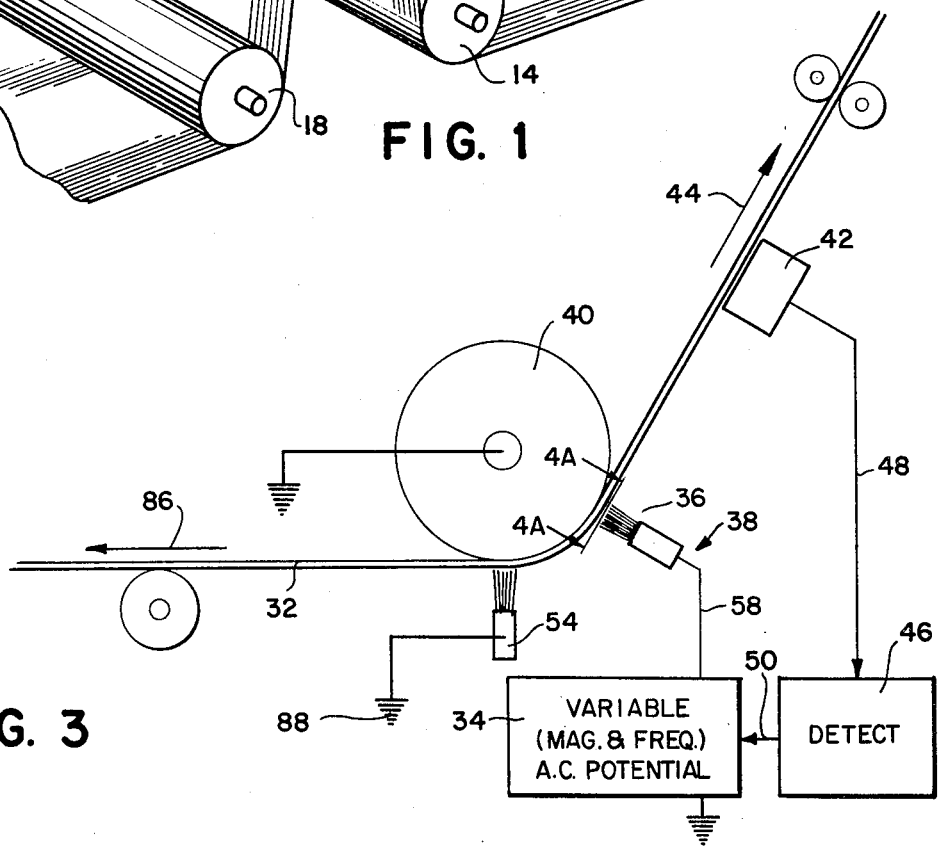
FIG. 3 is an elevational view of a moving web and charge-neutralizing apparatus as in FIG. 1, wherein said apparatus additionally includes an electrostatic charge-sensing feed back control device and a free-charge neutralizing brush.

In another embodiment of the present invention, depicted in FIG. 3, positive and negative electrostatic charges on moving charge-retaining web 32 are neutralized by apparatus similar to that in FIG. 1, except that an automatically variable AC potential source 34 is additionally included in said apparatus.

Variable AC potential source 34 is connected between electrically conductive bristles 36 of brush 38 and grounded backing roller 40 to produce an alternating electrostatic field between said bristles 36 and said backing roller 40. The magnitude and frequency of said variable potential source 34 is automatically varied between a range of AC potentials and/or a range of frequencies until the charge level on moving web 32 is reduced to zero as sensed by electrostatic charge sensor 42. As web 32 moves over grounded roller 40 in direction 44 said electrostatic charge level sensor 42 generates a signal that is detected by level detector 46 through path 48 and, in turn, produces a charge level signal at its output that is routed to variable AC potential source 34 through path 50. The charge level signal on path 50 is applied to variable AC potential source 34 where it causes said AC potential source 34 to automatically correct any error or charge level difference between the zero charge level that is desired and the actual charge level as sensed by electrostatic charge sensor 42 by varying the magnitude and/or frequency of the potential applied to brush 38 by said variable AC potential source 34.

In the apparatus of FIGS. 1 and 3, brushes 22 and 38 are spaced a finite distance from the moving charge-retaining web whose electrostatic charges they are neutralizing. By so spacing said brushes from their associated moving webs the magnitude of the potential applied to said brushes must be increased in order to obtain the same electrostatic fluid intensity over an arrangement where brushes 22 or 38 were in actual contact with their associated webs. This is so because the brush-to-web spacing introduces an electrical impedence or resistance to the generation of an electrostatic field between these components. The electrostatic charges on webs 10 and 32 can be properly neutralized at lower AC potentials when brushes 22 and 38 are in direct contact with said webs 10 and 32, respectively. However, charge neutralization would obviously be less uniform because of the movement of the free ends of the bristles by said webs 10 or 32 away from a more uniform row and column spatial orientation and because scratching of the surface of webs 10 and 32 may occur and such scratching may render these webs useless for incorporation in an end product.

Brushes that are utilized to neutralize the charges on charge-retaining material such as webs 10 and 32 in FIGS. 1 and 3, respectively, usually have a bristle or a filament density in excess of 120K filaments per square inch and preferably in excess of 150K filaments per square inch. The number of square inches of brush filaments and the physical dimensions of a particular brush are determined by considering such factors as the speed of web movement, the initial web charge levels and the type of material of which the web is formed. If, as in the charge neutralizing arrangement of FIG. 3, a web such as web 32 is moved over roller 40 at a relatively high rate of speed, it may be necessary to employ two or more brushes and space them about the circumference of said roller 40 in a manner similar to the placement of brushes 38 and 54, if a single brush is insufficient to neutralize web charges. Brushes 38 and 54 would then be connected, in parallel, to a common AC potential source such as source 34 and would not be connected as shown in said FIG. 3.

Figure 4A:
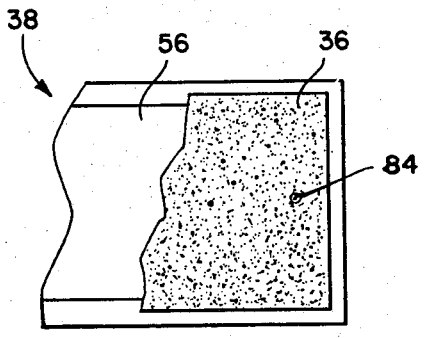
FIG. 4A is an enlarged fragmented, cross sectional view taken on the line 4A—4A in FIG. 3.
Figure 4B:
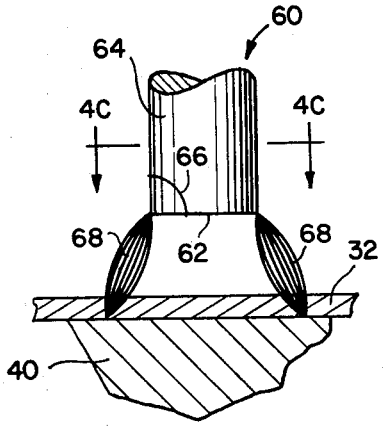
FIG. 4B is an enlarged elevational view of a portion of a single brush bristle of the type shown in FIG. 4A, a web and a backing roller.
Figure 4C:
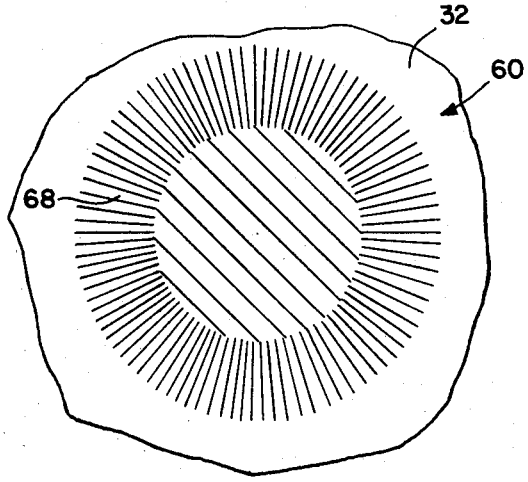
FIG. 4C is an enlarged cross sectional view taken on the line 4C—4C in FIG. 4B.

The constriction of a typical electrostatic charge neutralizing brush, such as brush 38 in FIG. 3, will now be explained in detail with a reference to FIGS. 3, 4A, 4B and 4C. In FIG. 4A, which is a fragmentary cross-sectional view taken on the line 4A—4A in FIG. 3, the free ends of a multiplicity of conductive bristles 36, are depicted. The opposite ends of these bristles 36 are firmly attached to electrically conductive mesh 56. Conductive mesh 56 constitutes a common electrical conductor that is connected to an AC potential source through, for example, path 58 in FIG. 3. A portion of a single conductive bristle or filament 60 of the multiplicity of conductive bristles 36 in FIG. 4A is shown, in elevation, in FIG. 4B. In addition, a cross-sectional view of said bristle 60 taken on the line 4C—4C of FIG. 4B is shown in FIG. 4C. Bristle 60 is circular in cross section as are all of the multiplicity of bristles 36, with the end surface 62 and the cylindrical surface 64 along the length of said bristles 60 intersecting at an angle 66 of 90°. Bristles 36 are normally constructed of conductive nylon or stainless steel. However, any conductive material having a resistance of 500 megohms or less may be employed as bristle material.

Surface 64 of bristle 60 is spaced from moving web 32 and a relatively intense alternating electrostatic field 68 is produced between the intersection of said surfaces 62/64 and grounded backing roller 40. It is a well-known electrical phenomenon that more intense electrostatic fields can be generated at a sharp or small radius of curvature surface for the same applied potential than at a smooth or a large radius of curvature surface.

In the interest of clarity, only a portion of complete electrostatic field 68 is shown in FIG. 4B. A more complete representation of electrostatic field 68 is shown in cross-sectional view of filament 60 illustrated in FIG. 4C. A portion of electric field 68 also exists between flat surface 62 of bristle 60 and backing roller 40. However, the low intensity of this portion of said field 68 has relatively little effect in neutralizing electrostatic charges as compared with that portion of electrostatic field 68 present at the periphery of said surface 62. In order to produce an electrostatic field between surface 62 of bristle 68 and backing roller 40 in FIG. 4B that would adequately neutralize electrostatic charges on said moving web 32, the magnitude of the potential between bristle 60 and grounded backing roller 40 would be so large that an undesirable corona would be generated. A bristle, such as bristle 60 in FIG. 4B can be utilized to produce the desired electrostatic field intensity to properly neutralize electrostatic charges on a moving web at AC potential levels that are substantially below the approximately 3.5 KV AC potential level where a corona would normally first appear and usually at less than half said potential magnitude.

Figure 5A:
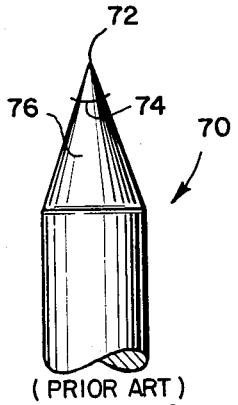
(PRIOR ART) FIG. 5A
FIG. 5A is a partial elevational view of a conventional, electrically conductive electrode of the type used for corona-type electrostatic field generation.

In prior art, corona-type electrostatic charge controlling apparatus, a plurality of electrical conductors or electrodes of circular cross section and pointed at one end, such as electrode 70 in FIG. 5A, were electrically connected to a common, corona-generating, potential source. The electrodes were usually made of copper or brass, were approximately 0.5 mm in diameter and were linearly spaced approximately 2 cm from each other across the width of a moving web whose retained electrostatic charge was to be regulated.

Figure 5B:
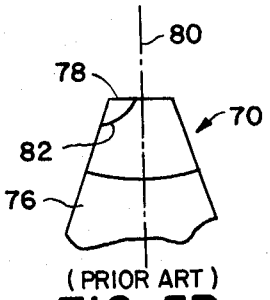
(PRIOR ART) FIG. 5B
FIG. 5B is an enlarged view of the pointed tip of the electrode shown in FIG. 5A.

On initial examination of pointed tip 72 of electrode 70 in FIG. 5A, without the aid of optical instruments, it would appear that angle 74 of said pointed tip 72, formed by conical surface 76, was smaller than angle 66 of bristle 60 formed by intersecting surfaces 62/64 in FIG. 4B. If said angle 74 were, in fact, smaller than said angle 66, one would expect to be able to generate a more intense electrostatic field, for the same applied potential, at tip 72 of electrode 70 than electrostatic field 68 produced between bristle 60 and backing roller 40 in FIG. 4B. In practice, however, the AC potential applied between electrode 70 and a reference surface must be far in excess of that applied between bristle 60 and backing roller 40 in FIG. 4B in order to achieve the same electrostatic field intensity. This is so because when tip 72 of electrode 70 in FIG. 5A is examined with the aid of optics, its shape closely resembles that shown in FIG. 5B. As shown in FIG. 5B, which is an enlargement of tip 72 in FIG. 5A, generally planar surface 78 is the actual shape of tip 72 of electrode 70, and said planar surace 78 is approximately at right angles with respect to longitudinal axis 80 of said electrode 70. This being so, the significant angle at tip 72 of electrode 78 in FIGS. 5A and 5B is not angle 74 formed by conical surface 76. In point of fact, the most significant angle at tip 72 of electrode 70 is angle 82 formed by conical surface 76 and generally planar surface 78. Angle 82 is approximately 130° and is substantially larger than the approximately 90° angle of angle 66 in FIG. 4B formed by intersecting surfaces 62/64. As previously explained, the smaller the radius of curvature the lower the electrical potential necessary for producing a particular electrostatic field intensity. With a larger angle and its attendant larger radius of curvature, substantially more electrical potential must be applied to electrode 70 in FIGS. 5A/5B than to filament 60 in FIG. 4B, when equally spaced from a reference surface, in order to produce the same electrostatic field intensity. With respect to bristles 36 of brush 38 in FIG. 3, the desired electrostatic field intensity for neutralizing electrostatic charges on charge-retaining web 32 can be obtained with a potential source connected to said bristles 36 that is well below the magnitude necessary for corona generation, a magnitude which is often in the neighborhood of 1500 volts AC.

When the diameter of bristles 36 (FIG. 4A) are relatively large (approximately 2.0 mils or larger) the size of angle 66 (FIG. 4B) begins to assume importance for low voltage electrostatic field generation. However, when bristle diameters become extremely small the entire free end of the bristles form a very small radius of curvature surface that acts as a point source from which a uniform electrostatic field can readily be established.

DISCUSSION

Electrostatic charges neutralized by the charge neutralizing apparatus of the present invention are primarily those resulting from dipole orientation. Dipoles that are fairly well aligned with respect to one another produce a relatively high or strong electrostatic charge level in charge-retaining materials whereas dipoles that are disoriented or grossly misaligned with respect to one another produce a relatively low or weak electrostatic charge level in such materials. Dipole orientation between either of these two extremes would, of course, produce corresponding electrostatic charge levels somewhere between the charge levels produced at said extremes. This dipole orientation and electrostatic effects resulting from the orientation thereof is fairly well understood in the prior art.

The relatively intense dipole orienting electrostatic field produced by a single bristle such as bristle 60 in FIG. 4B would be insufficient by itself to have any meaningful effect on the neutralization of a significant portion of the electrostatic charges on most charge-retaining materials. At best, such a single bristle may neutralize the charges on a very thin line of charge-retaining material as such material is moved past said single bristle.

On the other hand, an electrode in the form of a flat plate supported over charge-retaining materials for charge neutralizing purposes would require an extremely large-magnitude potential source, a magnitude that would cause corona. The apparatus of the present invention utilizes a very large number of bristles per square inch, but not so large that a plane passed through said bristles at right angles to their longitudinal axes would appear as a solid flat plate, without any openings therein. The smallest diameter possible for a bristle in a conductive bristle poling brush, such as brush 38 in FIG. 4A, appears to be in the vicinity of one micron. Conductive bristle brushes having bristle diameters of 50 microns or less are particularly useful as poling brushes because of the extremely uniform charge levels that such bristle produce on charge-retaining materials.

Figure 6:
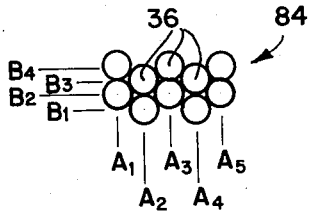
FIG. 6 is an enlarged detail of a portion of the conductive bristles depicted in FIG. 4A.

Poling brush 38 of FIG. 4A includes a multiplicity of bristles 36, having the same diameter, arrayed in a pattern that approximates a row and column grid when viewed from the free ends of said bristles as shown in said FIG. 4A. An enlarged detail 84 of a portion of bristles 36, as shown in FIG. 4A, is depicted in FIG. 6. As shown in detail 84 of FIG. 6, bristles 36 are arranged in columns $A_1$ through $A_5$ and rows $B_1$ through $B_4$ with rows $B_2$ and $B_4$, for example, being laterally offset from rows $B_1$ and $B_3$. By offsetting bristle rows, greater compacting and relatively high bristle densities can be obtained. It is not essential that the rows and columns of bristle 36 shown in FIG. 6 be perfectly straight for the proper operation of poling brush 38 so long as the required degree of bristle compaction or bristle denasity is obtained. Rows and columns of bristles of the size and densities mentioned above produce the electrostatic field strength that is necessary for low (less than corona) voltage electrostatic charge regulation.

Poling brushes such as brush 38 in FIG. 4A require large numbers of bristles arrayed in two generally perpendicular directions because of differences in bristle length that are not easily avoided. If two adjacent conductive bristles have significantly different lengths, the longer bristle or the one that is closer to a reference surface will be the one that produces the desired dipole orienting electrostatic field. The shorter of said two conductive bristles would contribute very little to the orientation of dipoles and may actually cause an electrostatic field void. From the foregoing, it follows that the preferred poling brush should, within limits, have as many "long" bristles as possible and have the free ends of said "long" bristles equidistant from said reference surface. By employing a brush with a nultiplicity of conductive bristles with the required degree of compactness or density, enough "long" bristles will be included to provide the required electrostatic field across the width of, for example, a moving web of charge-retaining material to uniformly neutralize positive and negative electrostatic charges on said material.

By utilizing the multiplicity of filaments such as in brush 38 of FIG. 4A in the manner described, electrostatic charge neutralization can readily be achieved. The number of poling brushes may have to be increased or the width of a particular poling brush may have to be varied for proper electrostatic charge neutralization. However, charge neutralization can be produced in charge-retaining materials with AC potentials that are substantially less than that necessary to generate corona, by utilizing the electrostatic charge neutralizing apparatus of the present invention or variations thereof.

When subjecting charge-retaining materials to the electrostatic field produced by the electrostatic charge neutralizing apparatus of the present invention for the desirable effect of neutralizing electrostatic charges by means of orienting dipoles, an undesirable change in the electrostatic charge level resulting from the change in the number of free surface charges produced by said dipole orienting or poling process will often occur. In order to control the extent to which the number of free surface charges increase during the poling process, a conductive bristle brush like that described in the above-mentioned BINKOWSKI patent may be utilized in addition to the conductive bristle brush used in the electrostatic charge neutralizing poling process of the present invention. Such an arrangement will be described with respect to FIG. 3.

If in FIG. 3, web 32 were moved in direction 86 instead of direction 44 over grounded backing roller 40, it would initially be subjected to a relatively intense electric-static field between poling brush 38, which is connected to potential source 34, and said backing roller 40. If web 32 continued to move in direction 84 over backing roller 40 between a grounded BINKOWSKI-type brush 54 and said backing roller 40, free charges on the surface of web 32 would discharge or pass through the filaments or bristles of brush 54 and into ground point 88 to which said filaments are electrically connected. Web 32 is preferably moved past grounded brush 54 after being subjected to poling brush 38. However, effective control of free charges can be achieved by discharging free surface charges on a moving web before said web is subjected to the electrostatic field provided by a brush polarizer.

It will be apparent to those skilled in the art from the foregoing description of my invention that various improvements and modifications can be made in it without departing from its true scope. The embodiments described herein are merely illustrative and they should not be viewed as the only embodiments that might encompass my invention.

What is claimed is:

1. Apparatus for uniformly neutralizing positive and negative electrostatic charges on charge-retaining materials, comprising:

a first common electrical conductor;

means for establishing an electrically conductive reference surface;

a first multiplicity of at least slightly electrically conductive elongated bristles supported over said reference surface with one end of said bristles being in an electrically coupled relation to said first common conductor, said bristles extending from their said one end toward said reference surface with the free ends of said filaments being adjacent said reference surface and with the positional relationship of said free ends approximating a row and column grid-like pattern; and an AC potential source connected between said common electrical conductor and said reference surface, said potential source having a predetermined magnitude and frequency for establishing an alternating electrostatic field for neutralizing positive and negative electrostatic charges on charge-retaining material passed between said free bristle ends and said reference surface such that said material is supported by said reference surface and is spaced a finite distance from said free bristle ends, said predetermined potential magnitude being less than that required for the generation of corona.

2. The apparatus of claim 1 wherein adjacent rows in said row and column grid-like structure are offset from one another.

3. The apparatus of claim 1, wherein the density of said bristles on said support is equal to or greater than 120 thousand bristles per square inch.

4. The apparatus of claim 1, wherein the diameter of said first multiplicity of bristles is equal to or less than 50 microns.

5. The apparatus of claim 1, wherein the electrical resistance of an individual bristle of said first multiplicity of bristles is equal to or less than 500 megohms.

6. The apparatus of claim 1, wherein a portion of the surface along the length of said bristles and a portion of the surface along the end of said bristles intersect at an angle of less than one hundred and thirty degrees.

7. The apparatus of claim 1, wherein a portion of the surface along the length of said bristles and a portion of the surface along the end of said bristles intersect at an angle equal to or less than ninety degrees.

8. The apparatus of claim 1, wherein said bristles are formed of stainless steel.

9. The apparatus of claim 1, wherein said bristles are formed of conductive nylon.

10. The apparatus of claim 1, further comprising:

a second common electrical conductor;

a second multiplicity of electrically conductive elongated bristles supported over said reference surface with one end of said bristles being in an electrically coupled relation to said second common conductor, with said second electrical conductor being electrically coupled to ground potential and with free electrostatic charges accumulated on the surface of charge-retaining material being removed from said material when moved between the free ends of said second multiplicity of bristles and said reference surface such that said material is in direct physical contact with the free ends of said second multiplicity of bristles.

11. Apparatus for regulating electrostatic charges on charge-retaining materials, comprising:

a common electrical conductor;

means for establishing an electrically conductive reference surface;

a multiplicity of electrically conductive elongated bristles supported over said reference surface with one end of said bristles being in an electrically coupled relation to said common conductor, said bristles extending from their said one end toward said reference surface with the free ends of said bristles being adjacent said reference surface and with the positional relationship of said free ends approximating a row and column grid-like pattern;

means for establishing a signal representative of the magnitude of the actual electrostatic charge level on a charge-retaining material;

means for establishing a signal representative of the desired electrostatic charge level on said charge-retaining material; and a variable AC potential source whose output is determined by said actual and said desired electrostatic charge level signals, the output of said AC potential source being connected between said common electrical conductor and said reference surface for the purpose of producing an alternating electric field for neutralizing positive and negative electrostatic charges on charge-retaining material passed between the free end of said multiplicity of bristles and said reference surface such that said material is supported by said reference surface and is spaced a finite distance from said free bristle ends, the magnitude of said AC potential source being less than that required for the generation of corona.

12. A method of neutralizing positive and negative electrostatic charges on charge-retaining materials, comprising steps of:

mounting a multiplicity of at least slightly conductive elongated bristles over a reference surface with one end of said bristles in an electrically coupled relation to a common conductor and the free ends thereof adjacent said reference surface, the positional relationship of the free ends of said bristles approximating a row and column grid-like pattern;

connecting an AC potential source having a particular magnitude and frequency between said common electrical conductor and said reference surface to establish an alternating electrostatic field between the free ends of said bristles and said reference surface, said predetermined potential source magnitude being less than that required for the generation of corona; and moving a charge-retaining material through said alternating electrostatic field between said free bristle ends and said reference surface in contact with said reference surface but spaced a finite distance from said free bristle ends to thereby uniformly neutralize positive and negative electrostatic charges on said charge-retaining material.

* * * * *